US008319805B2

(12) United States Patent
Chin et al.

(10) Patent No.: US 8,319,805 B2
(45) Date of Patent: Nov. 27, 2012

(54) SCREEN CONDENSATION WITH HETEROGENEOUS DISPLAY RESOLUTION

(75) Inventors: Vance Chin, San Francisco, CA (US); Brandon Sneed, Portland, OR (US); Joe Betts LaCroix, San Mateo, CA (US); Alok Gupta, Oakland, CA (US); Richard Pocklington, San Francisco, CA (US)

(73) Assignee: Google Inc., Mountain View, CA (US)

( * ) Notice: Subject to any disclaimer, the term of this patent is extended or adjusted under 35 U.S.C. 154(b) by 859 days.

(21) Appl. No.: 12/034,598

(22) Filed: Feb. 20, 2008

(65) Prior Publication Data

US 2009/0207195 A1 Aug. 20, 2009

(51) Int. Cl.
*G09G 5/02* (2006.01)

(52) U.S. Cl. ..... 345/698; 345/3.4

(58) Field of Classification Search ..... 345/3.3, 345/3.4, 698, 699

See application file for complete search history.

(56) References Cited

U.S. PATENT DOCUMENTS

| | | | | |
|---|---|---|---|---|
| 6,590,592 | B1 * | 7/2003 | Nason et al. | 715/778 |
| 7,010,755 | B2 | 3/2006 | Anderson et al. | |
| 7,796,141 | B2 * | 9/2010 | Sheridan | 345/660 |
| 2002/0101452 | A1 * | 8/2002 | Nason et al. | 345/764 |

* cited by examiner

*Primary Examiner* — Duc Dinh

(74) *Attorney, Agent, or Firm* — Morris & Kamlay LLP

(57) ABSTRACT

In one embodiment, a video signal is displayed on a display screen in two or more resolutions. The video signal may be of a first resolution and the display screen may be set to a second resolution. In one embodiment, the video signal resolution is of a size that is greater than the size of the display screen resolution. The method includes displaying a first portion of the video signal in a first resolution in a first region of the display. A second portion of the video signal is then displayed in a second resolution in a second region of the display. The second resolution is a resolution that displays at least a portion of the video signal that would be off screen if the video signal is displayed in the first resolution. Accordingly, more of the signal can be displayed on the screen.

23 Claims, 6 Drawing Sheets

SCREEN CONDENSATION WITH HETEROGENEOUS DISPLAY RESOLUTION

BACKGROUND

Particular embodiments generally relate to computing and more specifically to techniques for displaying information on a display screen.

Portable devices are becoming smaller and smaller, but processing power for them is increasing. Accordingly, these portable devices can provide many features that were previously not available. Although processing power has increased, what can be displayed on the portable devices is limited to the screens of the portable device, which are often small. Thus, a portable device is often able to process much more information than it is able to display.

For devices with larger screens and processing power, such as laptop computers and desktop computers, when a signal for content is sent in a larger resolution than that which the display is set at, a scroll bar is typically inserted in the content and it is cropped. In this case, a user can scroll through the portions of the content that are not displayed on the screen. This may be acceptable for some of the larger devices, but for smaller devices that have smaller display screens, putting a scroll bar on the screen takes up valuable space. Also, the scroll bars may be harder to use with the smaller devices because of mouse limitations, etc.

Also, the smaller devices may have non-rectangular monitors, which also make it more of a chance that a video signal sent at a certain resolution may not fit on the entire display screen. Many applications require a right-angle display and thus, any information that is displayed on a non-rectangular screen make it more likely it will include portions that are off screen. Accordingly, the chance that portions of the video signal may be off-screen may increase as smaller devices are used.

SUMMARY

Particular embodiments generally relate to techniques for displaying information on a display screen. In one embodiment, a video signal is displayed on a display screen in two or more resolutions. The video signal may be of a first resolution and the display screen may be set to a second resolution. In one embodiment, the video signal resolution is of a size that is greater than the size of the display screen resolution.

The method includes displaying a first portion of the video signal in a first resolution in a first region of the display. For example, the first region may include a larger portion of the display. A second portion of the video signal is then displayed in a second resolution in a second region of the display. For example, a portion of the display, such as an outside portion (e.g. a lower portion or side portion) may display the second portion of the video signal in a reduced resolution. The second resolution is a resolution that displays at least a portion of the video signal that would be off screen if the video signal is displayed in the first resolution. Accordingly, more of the signal can be displayed on the screen.

A further understanding of the nature and the advantages of particular embodiments disclosed herein may be realized by reference of the remaining portions of the specification and the attached drawings.

DETAILED DESCRIPTION OF EMBODIMENTS

Figure 1A:
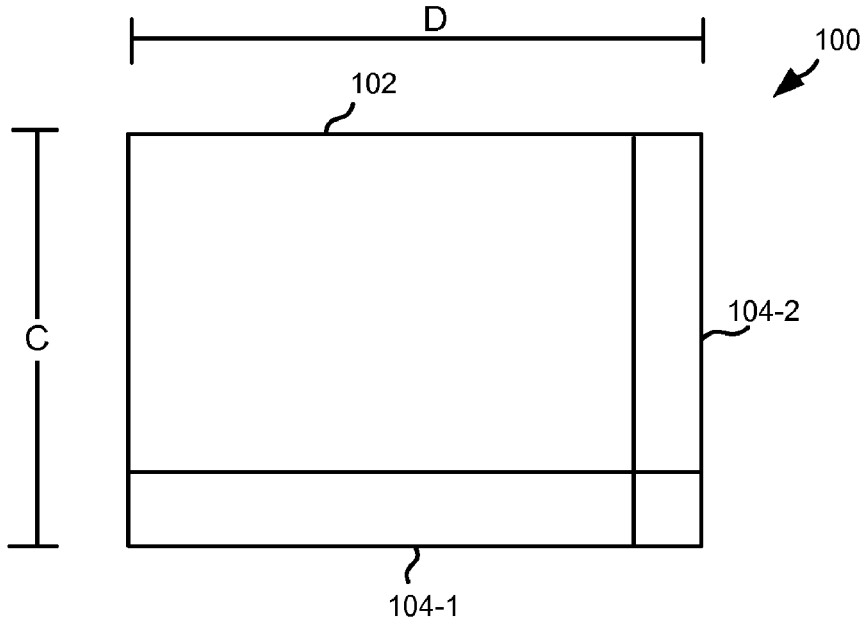
FIG. 1A depicts an example of a display according to one embodiment.

FIG. 1A depicts an example of a display 100 according to one embodiment. As shown, display 100 can display a signal for a resolution of the size C×D. In one embodiment, the size is represented in pixels, such as the screen is 480 pixels wide by 620 pixels long. In this case, C is the length and D is the width.

Figure 1B:
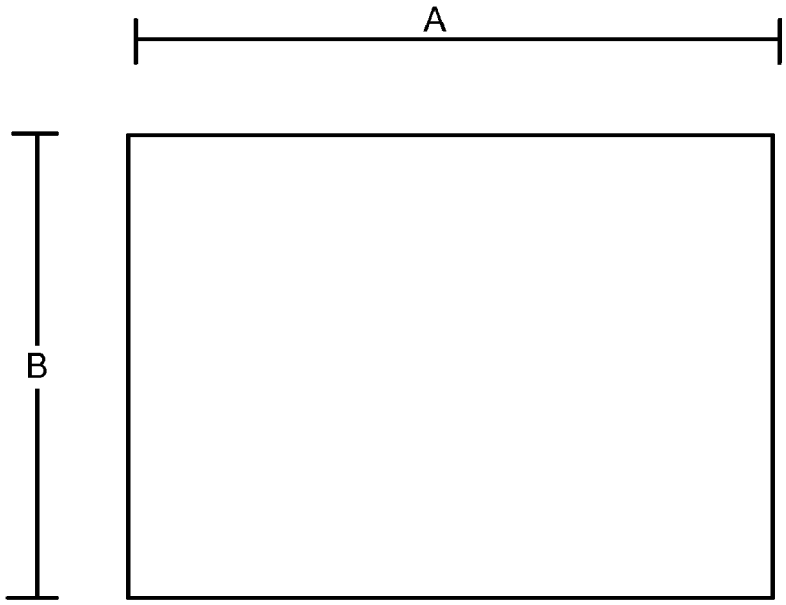
FIG. 1B shows the size of a video signal according to one embodiment.

FIG. 1B shows the size of a video signal according to one embodiment. The video signal is of a resolution of B×A (where A is the length and B is the width). In one embodiment, B is greater than C, A is greater than D, or both. For example, the video signal may be 640×480, which means the length is 640 pixels and the width is 480 pixels. However, display 100 may have a length of 620 pixels and a width of 480 pixels. Thus, if the signal is displayed without compression, then part of the signal would be off off-screen, i.e., the extra 20 pixels in the length-wise direction.

Referring back to FIG. 1A, display 100 includes a first region 102 and one or more second regions 104. First region 102 is considered a focus region where resolution is higher than second regions 104, which are considered non-focus regions. In one embodiment, first region 102 is a region that is in the middle or near the user's point of acuity that is high. Thus it is considered a focus region. For example, first region 102 may include most of display screen 100 except for either a bottom strip or a side strip. Regions 104 are considered non-focus regions because they may be at the periphery of display 100 and less likely to be focused on by a user.

Whether second region 104-1 and/or second region 104-2 are used may depend on a signal being displayed. In one embodiment, only one second region 104 may be provided at one time. Examples will be provided with each case singularly but it will be recognized that both second region 104-1 and second region 104-2 may be included in display 100 at the same time.

Figure 2A:
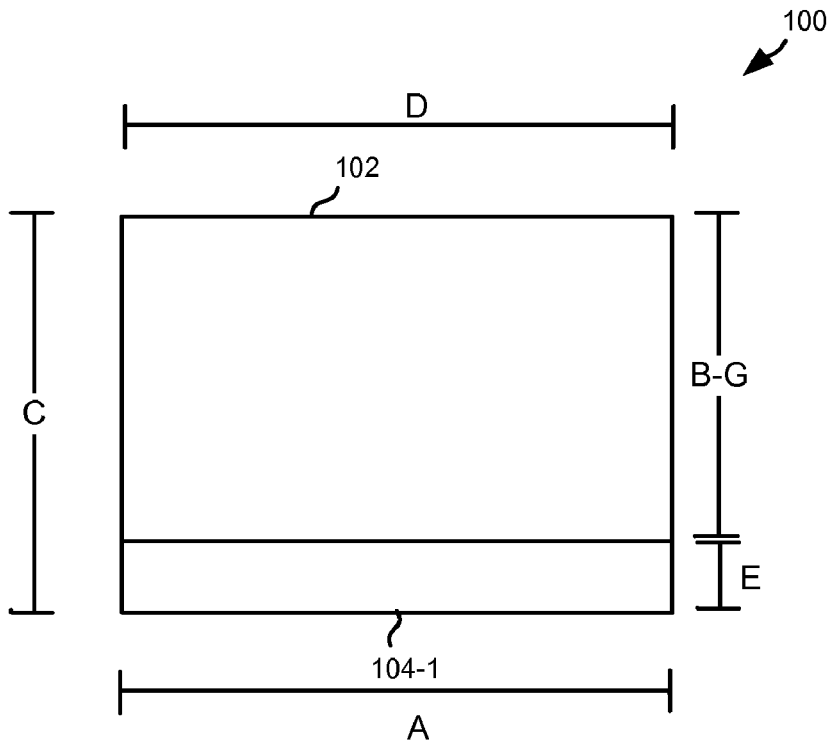
FIG. 2A depicts one example using a second region according to one embodiment.

FIG. 2A depicts one example using second region 104-1 according to one embodiment. In this case, the video signal may have a length longer than the length of display 100. In one example, display 100 may be 620×480 pixels. However, the video signal may be 640×480 pixels. Thus, the bottom 20 pixels of the video signal would not be displayed on display 100 if it was displayed without any compression. This is because the 640 pixels of the video signal are longer than the 620 pixels of display 100. Accordingly, embodiments of the present invention use a different resolution for second region 104-1 for at least a portion of the video signal.

In one embodiment, a portion of the video signal of the size B-G is displayed in first region 102. A second portion E is displayed in second region 104-1. The portion displayed in E may be displayed in a different resolution than the portion displayed in first region 102.

The resolution may be reduced in second region 104-1 such that more of the video signal may be displayed in region 104-1 than if the resolution for first region 102 is used. In one embodiment, the resolution may be reduced such that the entire video signal may be fit into display 100. For example, if B–G+E is displayed in display 100, then the entire video signal of B×A is displayed in B–G+E. This is because more information may be displayed in second region 104-1 at the reduced resolution. In one example, B–G may be 600 pixels long. So that means 600 pixels of the 640 pixel video signal may be displayed in first region 102. The remaining 40 pixels may be compressed at a reduced resolution and displayed in second region 104-1. This is represented by the size of E pixels. Normally, without compression, 20 pixels would have been displayed in second region 104-1 and 20 pixels would have been off screen. A scroll bar might have been generated to allow scrolling to the off screen portions. However, the scrollbar takes up valuable space on display 100. Thus, by compressing the last 40 pixels, they can be displayed in second region 104-1 without any off screen information and any scroll bar. Thus, the entire 640×480 image may be displayed.

Figure 2B:
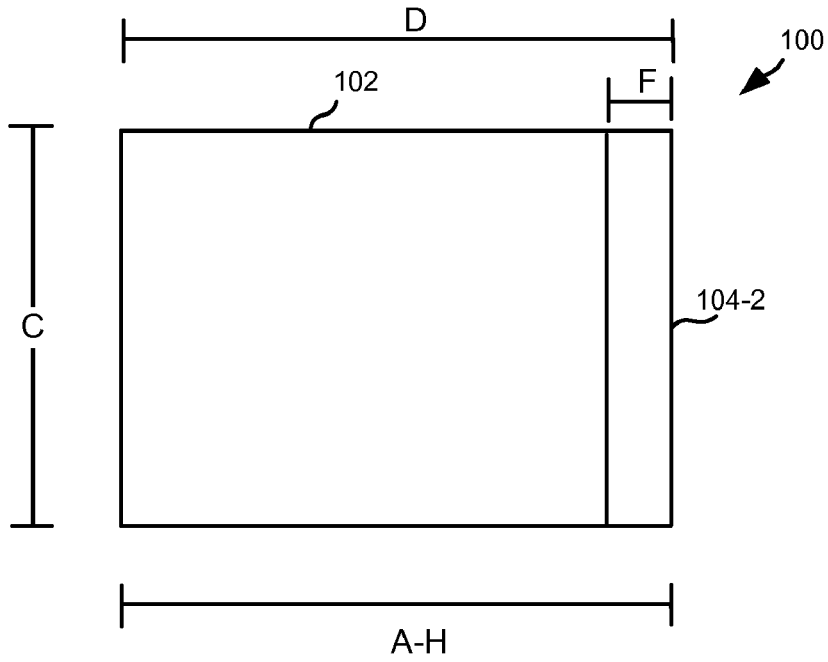
FIG. 2B shows an example of the display using the second region according to one embodiment.

FIG. 2B shows an example of display 100 using second region 104-2 according to one embodiment. In this case, the width of the video signal may be greater than the width of display 100. For example, the width of display 100 may be 460 pixels but the video signal's width is 480 pixels. Thus, 20 pixels may be off screen if the video signal is displayed at a 640×480 resolution.

Accordingly, a portion of the video signal, A-H, is displayed in first region 102. A next portion, F, is displayed in second region 104-2. The portion A-H is displayed at a first resolution and the portion E is displayed at a second resolution, which is less than the resolution for the portion of video signal A-H. For example, the portion A-H is displayed at a 640×480 resolution and a portion F is displayed at a 2:1 horizontal compression (e.g. 320×240). In one example, if the video signal is 640×480 and the screen is 620×480, then the portion A-H may be 640 pixels long and 440 pixels wide. This is displayed at a first resolution, which may be 640×480. The remaining 40 pixels in width may be displayed in second region 104-2 at the second resolution. Because the second resolution is reduced, the entire 40 pixels are fit in second region 104-2 and thus the entire video signal is displayed in display 100.

The resolution found in second region 104 may be a linear fraction or non-linear fraction of the resolution in first region 102. Using a linear fraction, the resolution is some resolution that is less than the first resolution used in first region 102. This is a constant throughout second region 104. For example, the resolution of first region 102 may be 640×480 and then the resolution of second region 104 may be 320×240, which is the same throughout second region 104.

For the non-linear resolution, part of second region 104 may be compressed at a second resolution and then another part may be compressed at a third resolution. For example, 80% of second region 104 may be compressed at the 320×240 resolution. 20% of second region 104 may be compressed even more, such as in a 3:1 ratio. This is non-linear through second region 104. It will be understood that any number of resolutions may be included in second region 104.

Although FIGS. 2A and 2B showed only one second region 104 in display 100 at one time, it will be recognized that second regions 104 may be both displayed at the same time. In this case, second region 104-1 may have a second resolution and second region 104-2 may have a third resolution. These resolutions may be different from one another or the same depending on the size of the video signal. Further, the second resolution and third resolution are a reduced resolution as compared to a first resolution of first region 102.

If both second regions 204-1 and 204-2 are used, a small region in a corner where second regions 204-1 and 204-2 overlap may occur. In this case, no information may be shown in this corner region. In another embodiment, information from one of the second regions 204-1 and 204-2 may be shown. Also, this region may be displayed in one or more intermediate resolutions.

Figure 3:
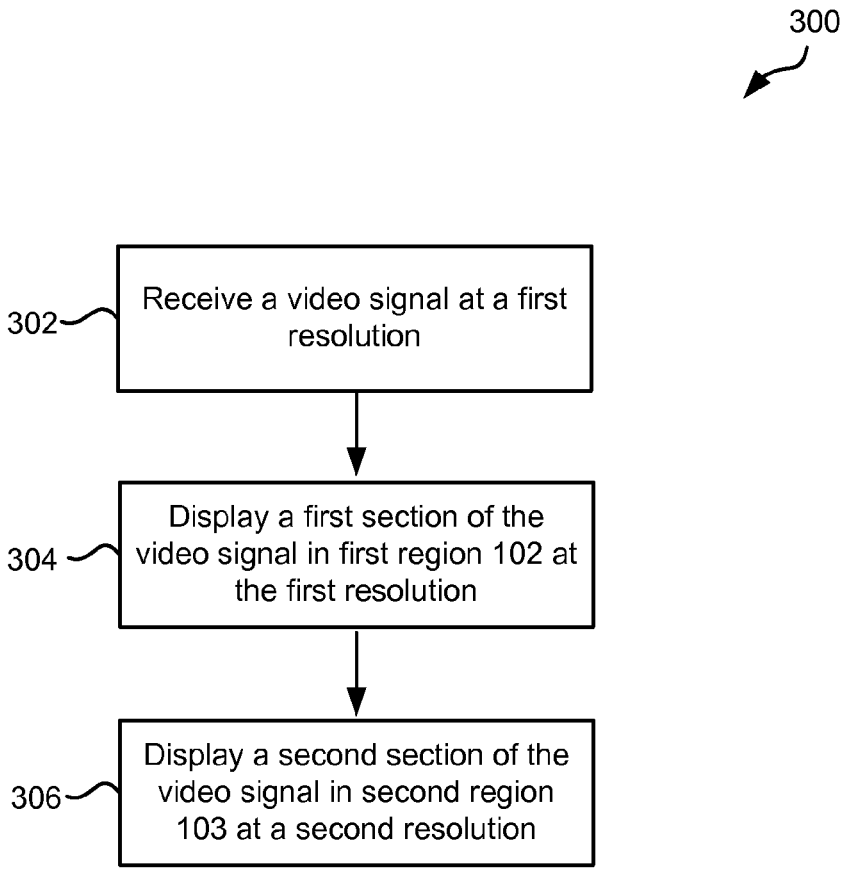
FIG. 3 depicts a simplified flow chart of a method for displaying a video signal according to one embodiment of the present invention.

FIG. 3 depicts a simplified flow chart 300 of a method for displaying a video signal according to one embodiment of the present invention. Step 302 receives a video signal at a first resolution. In one example, the first resolution is at a size that is greater than the size of display 100.

Step 304 displays a first section of the video signal in first region 102 at the first resolution. In this case, the signal is not compressed but displayed in a reduced area of display 100. Although it is discussed that the video signal is displayed in a first resolution, it will be recognized that it may be displayed in a different resolution than that which was received.

Step 306 then displays a second section of the video signal in second region 104 at a second resolution. The second resolution is less than the first resolution. Accordingly, more of the video signal may be displayed on display 100 than if the video signal was just displayed at the first resolution. For example, an entire video signal may be displayed by displaying a portion of the video signal using a reduced resolution. Additionally, the use of scroll bars may be avoided. Thus, optimal use of display 100 is provided.

Accordingly, embodiments provide a method of displaying a video signal such that information that may normally be off screen is displayed on screen. This may be determined dynamically as different resolutions in second region 104 may be used to display portions of the video signal.

Figure 4:
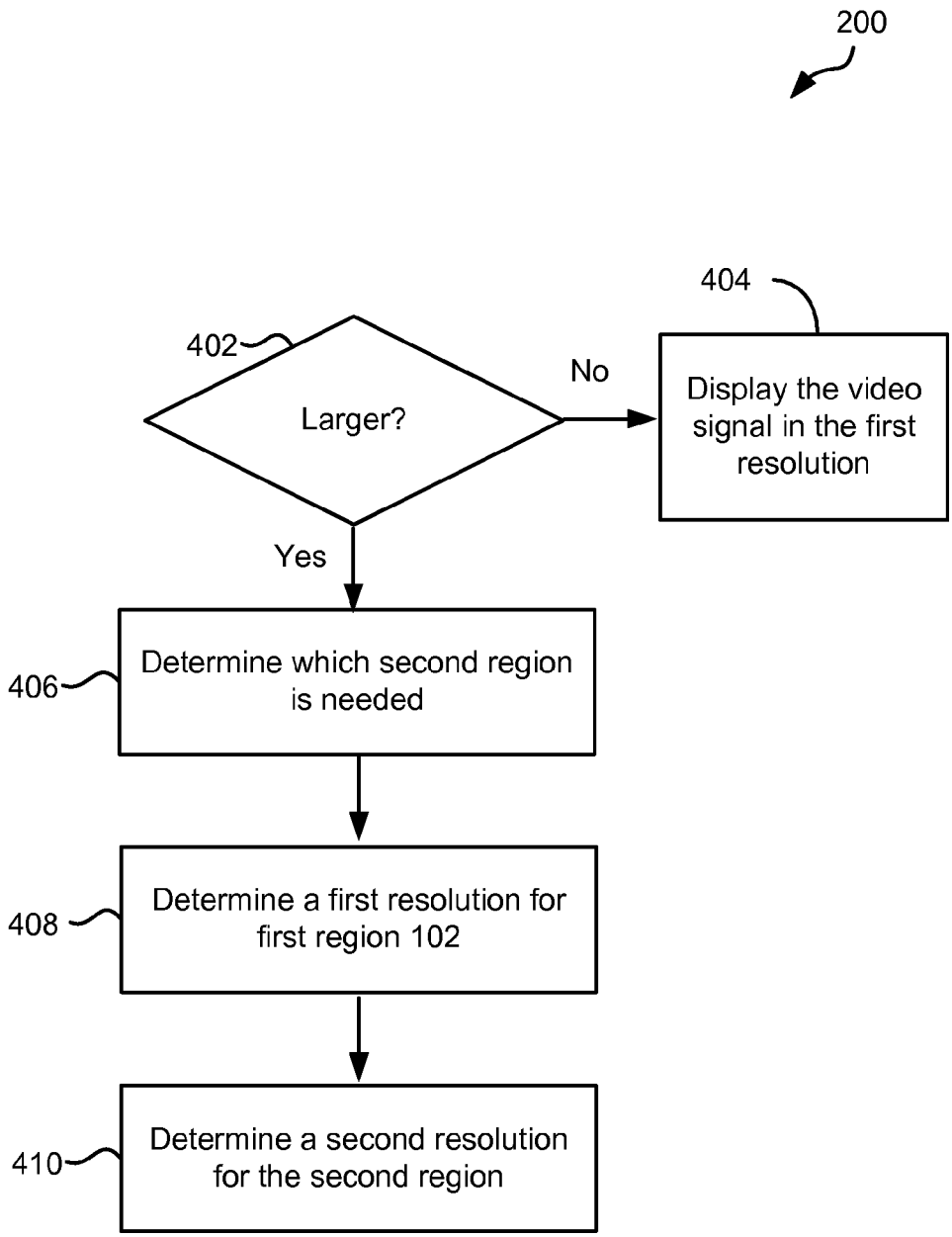
FIG. 4 depicts a simplified flow chart of a more detailed method for displaying a video signal according to one embodiment of the present invention.

FIG. 4 depicts a simplified flow chart 400 of a more detailed method for displaying a video signal according to one embodiment of the present invention. The decision as to which resolution should be displayed in second region 104 and whether to include region 104-1 and/or 104-2 may be determined dynamically. This may depend on a video signal that is received. The method described in flow chart 400 describes the dynamic properties of particular embodiments.

Step 402 determines if a video signal is of a size that is larger than display 100. If the video signal is not larger, then step 404 displays the video signal in the first resolution. This is done without using second regions 104. Accordingly, the entire video signal is displayed at the first resolution.

However, if the video signal is larger than display 100, step 406 determines which region 104 is needed. For example, either second region 104-1, second region 104-2, or both, may be needed. This may be determined based on the size of the video signal as compared to the size of display screen 100. If the video signal is longer than the size of display 100, then first region 104-1 may be needed; if the video signal is wider than display 100, then second region 104-2 may be needed.

Step 408 then determines a first resolution for first region 102. In one embodiment, an algorithm may be used to determine the best resolution for displaying a portion of the video signal in first region 102. In one embodiment, the resolution in which the video signal is received is used in first region 102. However, other resolutions may be used. This may be because the video signal is so large that the resolution may be compressed at a resolution of 2:1 just so most of the video signal may be displayed in display 100.

Step 410 determines a second resolution for second region 104. This may be performed for second region 104-1 and/or second region 104-2. In one embodiment, the second resolution is determined such that the entire video signal may be displayed on display 100. However, other determinations may be used to determine what the second resolution should be. For example, it may be determined that some information in the video signal does not need to be viewed by the user and thus it is not included in display 100. Accordingly, a second resolution is determined such that this information is not displayed in display 100.

Also, step 410 may determine if the resolution in second region 104 should be linear or non-linear. If it is non-linear, multiple resolutions may be determined.

Different algorithms may be used to determine the different resolutions and sizes of first region 102 and second region 104. For example, the distance a user is from display 100 may be used to determine the resolutions. If a user is farther away from display 100, then the resolution used for second region 102 may not be as compressed than if the user is closer. This is because user may not be able to see the display if it is compressed too much from a farther distance.

Figure 5:
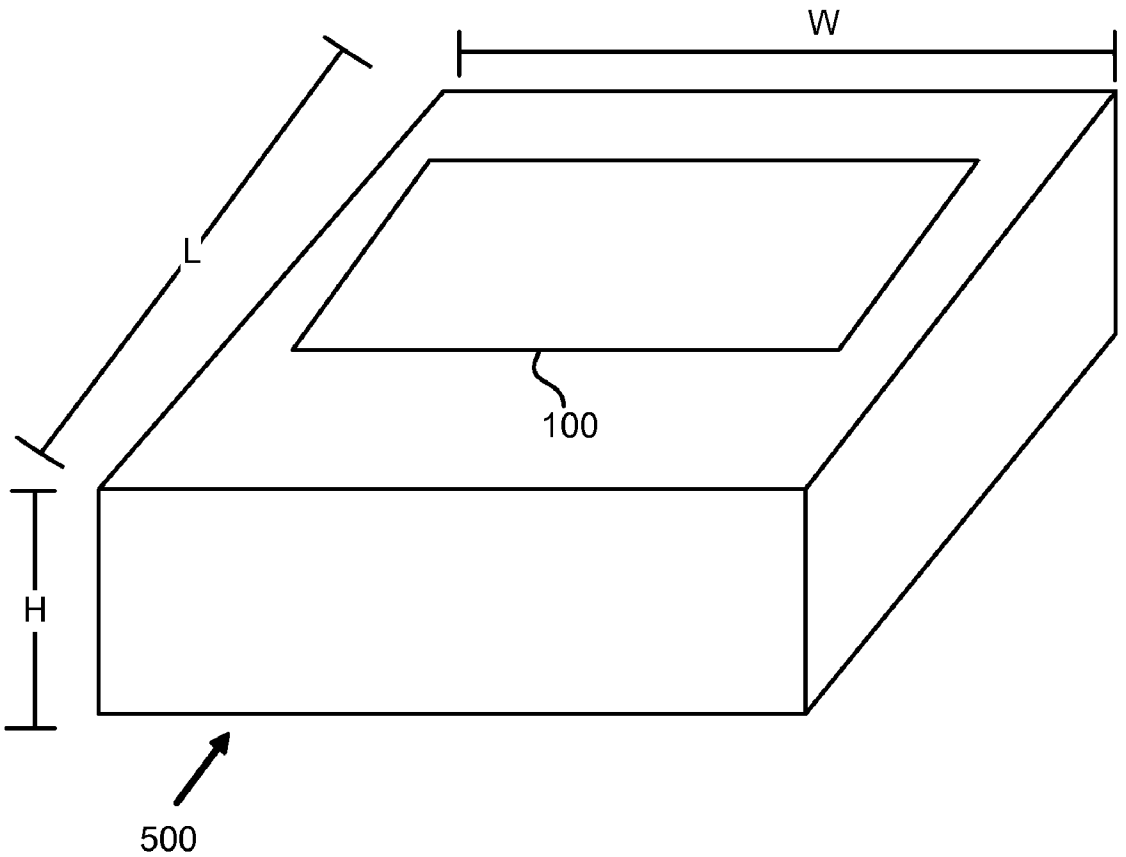
FIG. 5 shows an example device that may include the display according to one embodiment of the present invention.

FIG. 5 shows an example device 500 that may include display 100 according to one embodiment of the present invention. In one embodiment, device 500 may be a portable device. For example, device 500 may include a miniature computer, laptop computer, personal computer, personal digital assistant (PDA), cellular telephone, Blackberry device, pocket PC, etc. In other embodiments, device 500 is not limited to portable devices and may be used in any display device, such as a laptop computer, television, DVD display player, etc.

In one embodiment, the dimensions of device 500 may be a length, L, of substantially 4 inches; a width, W, of substantially 3 inches; and a height, H, of substantially ¾ inches. Additionally, the display may be a little under substantially 3 inches wide and substantially 4 inches long.

The display screen may be rectangular and the resolution may be 800×480. A signal with the resolution of 800×600 does not fit on the screen of device 500. Thus, signals from most applications may have off-screen information if second region 104 is not used. Thus, particular embodiments allow off-screen information for device 500 to be displayed.

Figure 6:
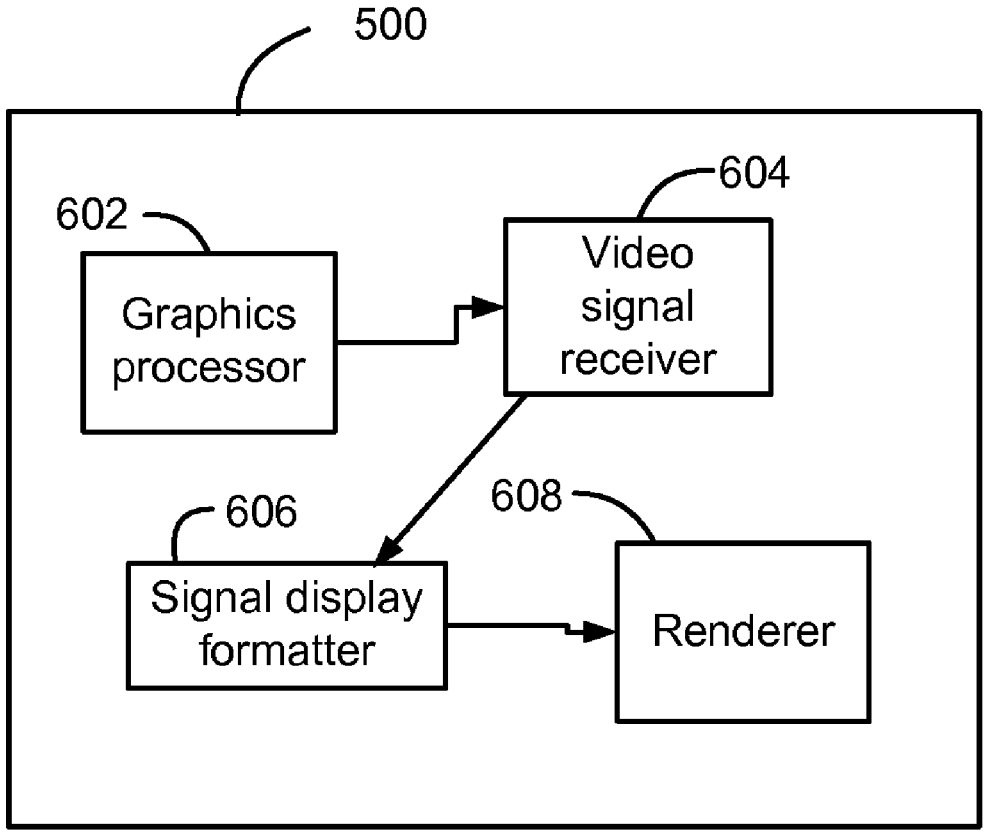
FIG. 6 depicts a more detailed embodiment of the device according to one embodiment of the present invention.

FIG. 6 depicts a more detailed embodiment of device 500 according to one embodiment of the present invention. As shown, a graphics processor 602, video signal receiver 604, a signal display formatter 606, and a renderer 608 are provided. Graphics processor 602 is configured to provide a video signal. The video signal is displayed at a first resolution.

Video signal receiver 604 receives the video signal and is configured to determine if second region 104 is needed. If second region 104 is not needed, then the video signal is not compressed. If it is, signal display formatter 606 is notified and is configured to determine the resolutions for the different regions 102 and 104.

A renderer 608 then renders the video signal in first region 102 and second region 104 with the determined resolutions.

Although the description has been described with respect to particular embodiments thereof, these particular embodiments are merely illustrative, and not restrictive. Although device 500 is described, it will be understood that any device with a display may use techniques described in embodiments of the present invention.

Any suitable programming language can be used to implement the routines of particular embodiments including C, C++, Java, assembly language, etc. Different programming techniques can be employed such as procedural or object oriented. The routines can execute on a single processing device or multiple processors. Although the steps, operations, or computations may be presented in a specific order, this order may be changed in different particular embodiments. In some particular embodiments, multiple steps shown as sequential in this specification can be performed at the same time. The sequence of operations described herein can be interrupted, suspended, or otherwise controlled by another process, such as an operating system, kernel, etc. The routines can operate in an operating system environment or as stand-alone routines occupying all, or a substantial part, of the system processing. Functions can be performed in hardware, software, or a combination of both. Unless otherwise stated, functions may also be performed manually, in whole or in part.

In the description herein, numerous specific details are provided, such as examples of components and/or methods, to provide a thorough understanding of particular embodiments. One skilled in the relevant art will recognize, however, that a particular embodiment can be practiced without one or more of the specific details, or with other apparatus, systems, assemblies, methods, components, materials, parts, and/or the like. In other instances, well-known structures, materials, or operations are not specifically shown or described in detail to avoid obscuring aspects of particular embodiments.

A "computer-readable medium" for purposes of particular embodiments may be any medium that can contain, store, communicate, propagate, or transport the program for use by or in connection with the instruction execution system, apparatus, system, or device. The computer readable medium can be, by way of example only but not by limitation, an electronic, magnetic, optical, electromagnetic, infrared, or semiconductor system, apparatus, system, device, propagation medium, or computer memory.

Particular embodiments can be implemented in the form of control logic in software or hardware or a combination of both. The control logic, when executed by one or more processors, may be operable to perform that what is described in particular embodiments.

A "processor" or "process" includes any human, hardware and/or software system, mechanism or component that processes data, signals, or other information. A processor can include a system with a general-purpose central processing unit, multiple processing units, dedicated circuitry for achieving functionality, or other systems. Processing need not be limited to a geographic location, or have temporal limitations. For example, a processor can perform its functions in "real time," "offline," in a "batch mode," etc. Portions of processing can be performed at different times and at different locations, by different (or the same) processing systems.

Reference throughout this specification to "one embodiment", "an embodiment", "a specific embodiment", or "particular embodiment" means that a particular feature, structure, or characteristic described in connection with the particular embodiment is included in at least one embodiment and not necessarily in all particular embodiments. Thus, respective appearances of the phrases "in a particular embodiment", "in an embodiment", or "in a specific embodiment" in various places throughout this specification are not necessarily referring to the same embodiment. Furthermore, the particular features, structures, or characteristics of any specific embodiment may be combined in any suitable manner with one or more other particular embodiments. It is to be understood that other variations and modifications of the particular embodiments described and illustrated herein are possible in light of the teachings herein and are to be considered as part of the spirit and scope.

Particular embodiments may be implemented by using a programmed general purpose digital computer, by using application specific integrated circuits, programmable logic devices, field programmable gate arrays, optical, chemical, biological, quantum or nanoengineered systems, components and mechanisms may be used. In general, the functions of particular embodiments can be achieved by any means as is known in the art. Distributed, networked systems, components, and/or circuits can be used. Communication, or transfer, of data may be wired, wireless, or by any other means.

It will also be appreciated that one or more of the elements depicted in the drawings/figures can also be implemented in a more separated or integrated manner, or even removed or rendered as inoperable in certain cases, as is useful in accordance with a particular application. It is also within the spirit and scope to implement a program or code that can be stored in a machine-readable medium to permit a computer to perform any of the methods described above.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated particular embodiments, including what is described in the Abstract, is not intended to be exhaustive or to limit the invention to the precise forms disclosed herein. While specific particular embodiments of, and examples for, the invention are described herein for illustrative purposes only, various equivalent modifications are possible within the spirit and scope, as those skilled in the relevant art will recognize and appreciate. As indicated, these modifications may be made to the present invention in light of the foregoing description of illustrated particular embodiments and are to be included within the spirit and scope.

Thus, while the present invention has been described herein with reference to particular embodiments thereof, a latitude of modification, various changes and substitutions are intended in the foregoing disclosures, and it will be appreciated that in some instances some features of particular embodiments will be employed without a corresponding use of other features without departing from the scope and spirit as set forth. Therefore, many modifications may be made to adapt a particular situation or material to the essential scope and spirit. It is intended that the invention not be limited to the particular terms used in following claims and/or to the particular embodiment disclosed as the best mode contemplated for carrying out this invention, but that the invention will include any and all particular embodiments and equivalents falling within the scope of the appended claims.

We claim:

1. A method for displaying a video signal on a display screen, the method comprising:

displaying a first portion of the video signal in an original resolution in a first region of the display screen; and displaying a second portion of the video signal at a compression ratio in a second region of the display screen, wherein the compression ratio displays at least a portion of the video signal that would be off screen if the video signal was displayed in the original resolution;

wherein the video signal has at least one dimension larger than the corresponding dimension of the display screen.

2. The method of claim 1, wherein the first region is of a larger size than the second region.

3. The method of claim 2, wherein the second region is located in an outer area of the display.

4. The method of claim 1, wherein the video signal is displayed completely in the first region and the second region of the display.

5. The method of claim 1, wherein the compression of the second portion of the video signal is a linear or non-linear fraction of the original resolution.

6. The method of claim 1, wherein the second portion of the video signal is reduced in one dimension.

7. The method of claim 1, wherein the second portion of the video signal is reduced in two or more dimensions.

8. The method of claim 1, wherein a horizontal second region and a vertical second region overlap creating a border zone.

9. The method of claim 8, wherein the border zone created by the overlap is displayed in one or more intermediate compression ratios, wherein the intermediate compression ratios are lower than the second compression ratio.

10. An apparatus configured to display a video signal on a display screen, the apparatus comprising:

one or more processors; and logic encoded in one or more non-transitory computer-readable storage media for execution by the one or more processors and when executed operable to:

display a first portion of the video signal in an original resolution in a first region of the display screen; and display a second portion of the video signal in a compression ratio in a second region of the display screen, wherein the compression ratio displays at least a portion of the video signal that would be off screen if the video signal was displayed in the original resolution;

wherein the video signal has at least one dimension larger than the corresponding dimension of the display screen.

11. The apparatus of claim 10, wherein the first region is of a larger size than the second region.

12. The apparatus of claim 11, wherein the second region is located in an outside area of the display.

13. The apparatus of claim 10, wherein the video signal is displayed completely in the first region and the second region of the display.

14. The apparatus of claim 10, wherein the compression ratio of the second portion of the video signal is reduced by a linear or non-linear fraction of the original resolution.

15. The apparatus of claim 10, wherein the second portion of the video signal is reduced in one dimension.

16. The apparatus of claim 10, wherein the second portion of the video signal is reduced in two or more dimensions.

17. The apparatus of claim 10, wherein a horizontal second region and a vertical second region overlap creating a border zone.

18. The apparatus of claim 17, wherein the border zone created by the overlap is displayed in one or more intermediate compression ratios.

19. One or more non-transitory computer-readable storage media storing instructions for execution by one or more processors to:

display a first portion of the video signal in an original resolution in a first region of the display; and display a second portion of the video signal in a compression ratio in a second region of the display, wherein the compression ratio displays at least a portion of the video signal that would be off screen if the video signal was displayed in the original resolution;

wherein the video signal has at least one dimension larger than the corresponding dimension of the display screen.

20. The storage media of claim 19, wherein the first region is of a larger size than the second region.

21. The method of claim 1, wherein the video signal has a resolution larger than the maximum resolution displayable by the display screen without compression.

22. The method of claim 1, wherein the original resolution corresponds to a compression ratio of 1:1.

23. A method for displaying a video signal on a display screen, the method comprising:

displaying a first portion of the video signal in a first resolution in a first region of the display screen; and displaying a second portion of the video signal in a second resolution in a second region of the display screen, wherein the second resolution displays at least a portion of the video signal that would be off screen if the video signal was displayed in the first resolution;

wherein the video signal has at least one dimension larger than the corresponding dimension of the display screen; and wherein the second portion of the video signal is reduced in two or more dimensions.

* * * * *